US005755085A

United States Patent [19]

Insley

[11] Patent Number: 5,755,085

[45] Date of Patent: May 26, 1998

[54] SPINDLE BRAKE ACTUATOR

[76] Inventor: Roger E. Insley, 404 Peerless La., Lowell, N.C. 28098

[21] Appl. No.: 862,580

[22] Filed: May 23, 1997

[51] Int. Cl.[6] ..... D01H 13/18

[52] U.S. Cl. ..... 57/88; 57/78; 57/89

[58] Field of Search ..... 57/88, 89, 78, 57/61; 242/422.9

[56] References Cited

U.S. PATENT DOCUMENTS

| | | | |
|---|---|---|---|
| 2,481,043 | 9/1949 | Sacchini | 57/88 |
| 2,648,948 | 8/1953 | Soussloff et al. | 57/89 |
| 2,770,092 | 11/1956 | Wood | 57/88 |
| 3,016,679 | 1/1962 | Rakhorst | 57/36 |
| 3,226,923 | 1/1966 | Maurer | 57/88 |
| 3,466,865 | 9/1969 | Franzen et al. | 57/88 |
| 3,641,836 | 2/1972 | Boggs et al. | 74/512 |
| 3,645,084 | 2/1972 | Nimtz | 57/88 |
| 3,673,783 | 7/1972 | Timbie | 57/88 |
| 4,662,165 | 5/1987 | Menegatto | 57/88 |
| 5,417,047 | 5/1995 | Locatelli | 57/89 |
| 5,507,140 | 4/1996 | Mann et al. | 57/88 |

*Primary Examiner*—William Stryjewski

[57] ABSTRACT

A portable actuator for a spindle brake associated with a textile machine includes a body, an arrangement for biasing the spindle brake operator to operate the spindle brake to halt rotation of the spindle with the biasing arrangement mounted to the body and an arrangement for retaining the actuator in an engaged operating relationship with the spindle brake operator with the retaining arrangement being mounted to the body with the entire device being selectively attachable to and detachable from the textile machine.

12 Claims, 3 Drawing Sheets

SPINDLE BRAKE ACTUATOR

BACKGROUND OF THE INVENTION

The present invention relates broadly to operational accessories for textile machines including ring spinning machines and, more particularly, to a portable actuator for use with a spindle brake on a ring spinning machine.

Spinning machines are used to wind textile strand material onto bobbins to form yarn packages. They typically include a number of identical spinning stations whereat textile strand material is directed onto the bobbin fixed to a rotating spindle for winding. These identical spinning stations are typically aligned along the framework of a spinning machine. As may be expected, in ordinary operations, each spinning station includes individually operable rotating spindles such that individualized control of the spinning stations is available should a yarn break or other disruption occur at one of the spinning stations.

Part of the control associated with individual spinning stations, and, more particularly, the rotating spindle, is a spindle brake which will act to halt rotation of the spindle and, accordingly, the associated bobbin so that an attendant can make adjustments which may include removing entanglements, strand breakage repair or curing other problems which may require stoppage of the spindle rotation. Accordingly, each individual spinning station is equipped with a spindle brake operator for manual use by an attendant.

The spindle brake operator is positioned on the machine frame at a position for engagement by an attendant's knee. A footrest portion of the frame is provided and the spindle brake operator is pivotally mounted to the frame such that, when an attendant pushes on the operator with his or her knee, the spindle brake is actuated and spindle rotation stops and remains halted until the attendant releases the operator. As may be expected, this places a burden on the attendant who has to operate the spindle brake while attending to the machine condition which gave rise to the need to stop spindle rotation.

Accordingly, there exists a need for a device or method to halt spindle rotation and maintain this stoppage without further input from the attendant.

SUMMARY OF THE INVENTION

It is accordingly an object of the present invention to provide a spindle brake actuator which can be used equally well by anyone and allows the brake to be engaged and maintained in engagement while unattended.

It is another object of the present invention to provide a spindle brake actuator which is portable and easy to use.

To that end, a portable actuator is provided for a spindle brake associated with a textile spinning machine, the spindle brake being operatively associated with a spindle and the spindle being associated with the textile machine for take-up of textile strands by rotating a take-up bobbin mounted thereto. The actuator acts on a spindle brake operator associated with the spinning machine and is operatively connected to the spindle to selectively halt rotation thereof with the actuator being selectively mountable to the textile machine to cause the spindle brake operator to engage and operate the spindle brake to halt spindle rotation. The spindle brake actuator includes a body and an arrangement for biasing the spindle brake operator to operate the spindle brake to halt rotation of the spindle with the biasing arrangement being mounted to the body. Further, an arrangement for retaining the actuator in an engaged operating relationship with the spindle brake operator is provided and the retaining arrangement is mounted to the body and is selectively attachable to and detachable from the textile machine.

Preferably, the spindle brake actuator further includes a handle mounted to the body for manual engagement thereof to selectively attach the body to and detach the body from the textile machine. It is further preferred that the arrangement for biasing the spindle brake operator includes a contoured member mounted to and projecting outwardly from the body for engagement with the spindle brake operator. Preferably, the arrangement for retaining the actuator in an engaged operating relationship with the spindle brake operator includes at least one magnet mounted to the body and projecting outwardly therefrom for attachment to and detachment from a metal portion of the textile machine.

It is further preferred that the arrangement for biasing the spindle brake operator includes a contoured resilient member projecting outwardly from the body for engagement with the spindle brake operator, and the arrangement for retaining the actuator in an engaged, operating relationship with the spindle brake operator includes at least one magnet mounted to the body adjacent the contoured resilient member and projecting outwardly from the body for attachment to and detachment from a metal portion of the textile machine in and out of operating engagement with the spindle brake operator. It is further preferred that the arrangement for retaining the actuator in an engaged operating relationship with the spindle brake operator includes a pair of elongate magnets mounted to the body, with one member of the pair of magnets being mounted to the body at a first position adjacent the contoured resilient member and a second member of the pair of magnets being mounted to the body at a second position adjacent the contoured resilient member with the pair of magnets projecting outwardly from the body for attachment to and detachment from a metal portion of the textile machine. Preferably, the magnets are formed as a pair of cylinders.

It is further preferred that the body be formed as a generally flat member having at least two planar sides with the arrangement for biasing the spindle brake operator to operate the spindle brake to halt rotation of the spindle and the arrangement for retaining the actuator in an engaged operating relationship with the spindle brake operator is mounted to a first planar side of the body and projects outwardly therefrom for selective attachment to and detachment from the textile machine.

It is further preferred that the handle be formed as a T-shaped member mounted to the body for manual engagement thereof. Preferably, the handle is formed as at least one T-shaped member and is mounted to the body on a second planar side thereof for manual engagement of the T-shaped member for selective attachment of the actuator to and detachment of the actuator from the textile machine. It is further preferred that the handle include two T-shaped members disposed in a side-by-side relationship on the second planar side of the body for manual engagement for selective attachment of the actuator to and detachment of the actuator from the textile machine.

By the above, the present invention provides a portable spindle brake actuator which may be easily used by a textile machine attendant to selectively halt rotation of a spindle and maintain the spindle in a non-rotating state without further input from the attendant.

DETAILED DESCRIPTION OF THE INVENTION

Figure 1:
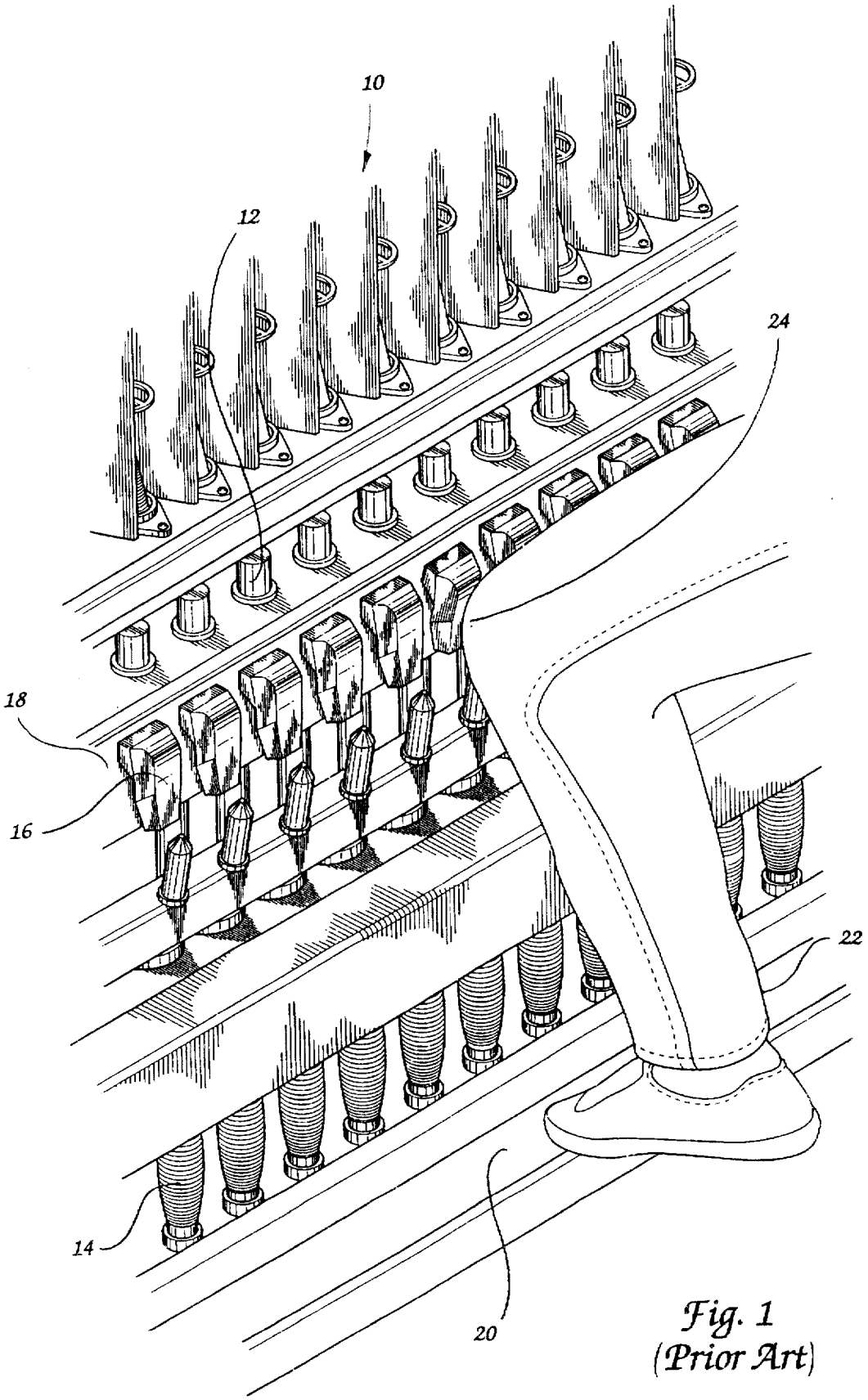
Fig. 1 (Prior Art)
FIG. 1 is a perspective view of a portion of a textile spinning machine illustrating the prior art method of spindle brake actuation.

Turning now to the drawings and, more particularly, to FIG. 1, a textile spinning machine is illustrated with respect to a prior art technique of spindle brake operation. The textile spinning machine is essentially conventional and is illustrated generally at 10. The textile machine 10 includes an elongate metal frame 18 composed of various generally planar, metal support members mounted thereto. A spindle 12 includes a cylinder rotatably mounted to the frame 18 and is driven into rotation along with a plurality of other like spindles. A bobbin 14 is mounted to the spindle for rotation therewith for taking up threads, yarn or other textile strand material to form a package or cheese.

As will be appreciated by those skilled in the art, often a strand will break, become entangled or otherwise require stoppage of an individual, rotating yarn package which is caused by the operator initiating spindle brake operation. According to the prior art, spindle brake operation is initiated by pressing on the spindle brake operator.

The spindle brake operators 16 are aligned with the spindles 12 on the spinning machine frame 18 and are formed as generally L-shaped bumper members which are pivotally mounted to the frame 18. The L-shape appears in cross-section and extends to a predetermined width to create an operational surface which may be pressed by the attendant to operate the spindle brake. The spindle brake itself is not shown, but it will be appreciated by those skilled in the art that the spindle brake is conventional and is operated by the aforesaid spindle brake operators. The attendant places a foot on a foot rail 20 portion of the frame 18 and then the attendant 22 places his or her knee 24 against the spindle brake operator 16 to cause a rocking motion to bias the spindle brake operator to operate the spindle brake.

The attendant 22 must remain with his or her knee 24 in contact with the spindle brake operator 16 in order to maintain the spindle brake in operational engagement with the spindle to maintain the spindle in a non-rotating state. Upon release, the spindle brake operator rocks back to a non-operational position and the spindle once again rotates. As may be appreciated, it may sometimes be difficult for the attendant to maintain engagement with the spindle brake operator 16 while attending to whatever condition required stopping the spindle brake. Further, size differences between attendants can also become problematic when trying to maintain the spindle brake in a braking state.

Figure 2:
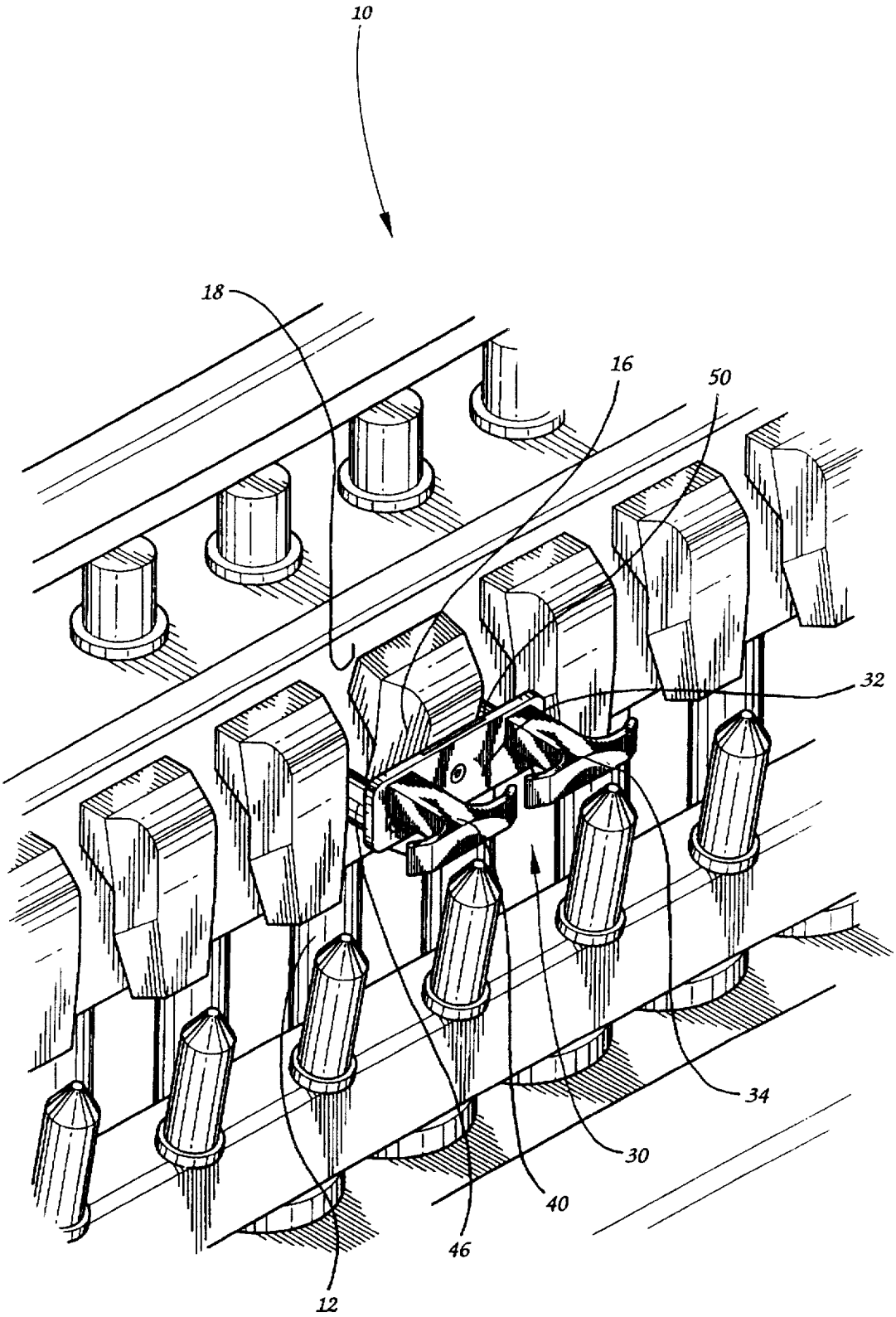
FIG. 2 is a perspective view of a portion of a textile spinning machine with the spindle brake actuated using a portable spindle brake actuator according to the preferred embodiment of the present invention.
Figure 4:
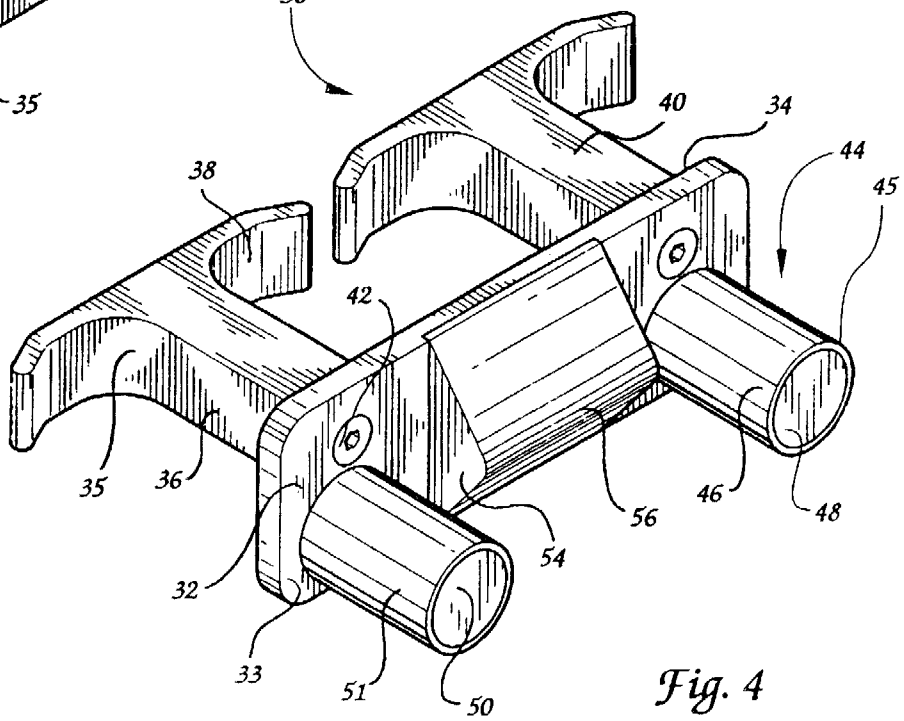
FIG. 4 is a rear perspective view of the spindle brake actuator illustrated in FIG. 3.
Figure 3:
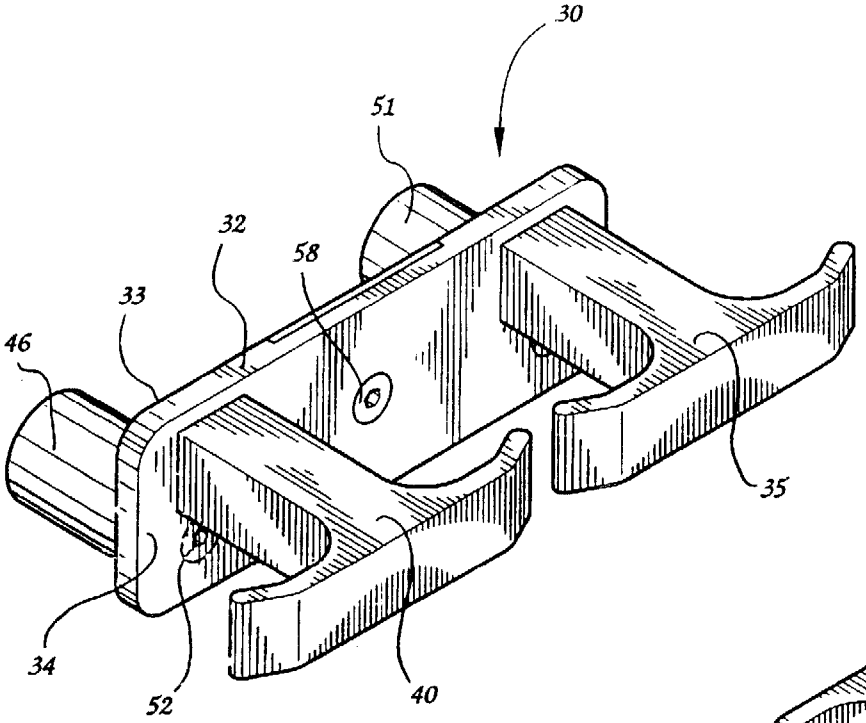
FIG. 3 is a rear perspective view of a portable spindle brake actuator according to the preferred embodiment of the present invention.

According to the preferred embodiment of the present invention, a portable spindle brake operator is provided for selective attachment to the textile machine 10 as seen in FIG. 2. Referring now to FIGS. 3 and 4, a portable spindle brake actuator is illustrated generally at 30 and includes a planar, rectangular body 32 which may be formed from aluminum, metal, plastic or other suitable rigid material. The body 32 includes a first planar side 33 and an oppositely facing second planar side 34 separated from the first planar side 33 by the thickness of the body 32.

In order to provide an arrangement for an attendant to attach and detach the portable spindle brake actuator to the textile machine, a pair of handles 35,40 is provided. The handles 35,40 are formed as generally T-shaped members including a shank 36 and two laterally extending engagement members 38 projecting in opposite directions from one end of the shank 36. Each T-shaped handle 35,40 is mounted to the body 32 using screws 42 which pass through the body 32. The handles 35,40 are mounted in a side-by-side parallel relationship and project outwardly from the second surface 34 of the body 32.

In order to actuate the spindle brake, the spindle brake operator 16 must be depressed and held into position, as seen in FIG. 2. To that end, an actuating member 54 is provided. The actuating member 54 is mounted to the first planar side 33 of the body 32 to project outwardly therefrom in a direction opposite from the projecting direction of the T-shaped handles 35,40. The actuating member 54 is triangular in cross-section and extends across a predetermined width to create a member having sloped side portions and a projecting edge 56. A flat surface is likewise formed by the triangular cross-sectional nature of the actuating member 54 and this flat surface is used for mounting the actuating member 54 on the first planar surface 33 of the body 32. A screw 58, seen in FIG. 3, passes through the body 32 for threaded engagement with the actuating member 54 to retain it in place on the body 32. As a result, the projecting edge 56 of the actuating member 54 is positioned a distance away from the body 32. It will be understood by those skilled in the art that the particular cross-sectional shape and the resulting outer contour of the actuating member 54 is not critical for operation. In fact, based on the shape of the spindle brake operator 16, the actuating member 54 may take several different forms with the primary requirements being its mountability to the body 32 and its projecting nature which allows it to encounter and operate the spindle brake operator 16.

In order to retain the actuator 30 of the present invention in spindle brake operational engagement with the textile machine 10, at least one magnet and preferably two magnets illustrated generally at 44 are provided. According to the preferred embodiment of the present invention, a pair of cylindrical magnets 48,50 are mounted to the body 32 with one magnet on either side of the actuating member 54. Each magnet 48,50 includes a corresponding cylindrical shroud 46,51. Once again, it will be appreciated by those skilled in this art that the magnets need not necessarily be cylindrical. Since the magnets 48,50 are positioned on either side of the actuating member 54, a balanced effect is achieved. Similarly, the dual T-shaped handles 35,40 provide a balanced effect for convenient attachment to and removal from the textile machine 10.

Operation of the portable spindle brake actuator 30 according to the preferred embodiment of the present invention is best illustrated in FIG. 2. There, the actuator 30 is shown engaging and operating a spindle brake operator 16. Once a yarn break or other situation occurs which requires the attendant to engage one of the spindle brakes, the attendant obtains the portable device and positions it with the first surface 33 directed toward the spindle brake operator 16. The spindle brake operator 16 is then engaged by the projecting edge 56 of the actuating member 54 and the magnets 48,50 are drawn to the metal of the textile machine frame 18 which causes the spindle brake operator 16 to pivot into operation, thus engaging the spindle brake and halting rotation of the spindle. The magnets 48,50 retain the portable spindle brake actuator against the textile machine frame 18 and maintain the braking action until the condition is relieved by an attendant.

By the present invention, the spindle brakes on a textile spinning machine may be individually stopped and remain in a stopped condition indefinitely. Further, by using multiple actuators according to the present invention, several spindles may be stopped at once without placing the attendant under dangerous conditions.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A portable actuator for a spindle brake associated with a textile spinning machine, the spindle brake being operatively associated with a spindle, the spindle being associated with the textile spinning machine for take-up of textile strands by rotating a take-up bobbin mounted thereto, said actuator acting on a spindle brake operator associated with the textile spinning machine and operatively connected to the spindle to selectively halt rotation thereof, said actuator being selectively mountable to the textile machine to cause the spindle brake operator to engage and operate the spindle brake to halt spindle rotation, said spindle brake actuator comprising:

a body;

means for biasing the spindle brake operator to operate the spindle brake to halt rotation of the spindle, said biasing means being mounted to said body; and means for retaining said actuator in an engaged, operating relationship with the spindle brake operator, said retaining means being mounted to said body and selectively attachable to and detachable from the textile machine.

2. A portable actuator for a spindle brake according to claim 1 and further comprising a handle mounted to said body for manual engagement thereof to selectively attach said body to and detach said body from the textile machine.

3. A portable actuator for a spindle brake according to claim 2 wherein said handle is formed as a T-shaped member mounted to said body for manual engagement thereof.

4. A portable actuator for a spindle brake according to claim 1 wherein said means for biasing the spindle brake operator includes a contoured member mounted to and projecting outwardly from said body for engagement with the spindle brake operator.

5. A portable actuator for a spindle brake according to claim 4 wherein said body is formed as a generally flat member having at least two planar sides with said means for biasing the spindle brake operator to operate the spindle brake to halt rotation of the spindle and said means for retaining said actuator in an engaged, operating relationship with the spindle brake operator being mounted to a first planar side of said body and projecting outwardly therefrom for selective attachment to and detachment from the textile machine.

6. A portable actuator for a spindle brake according to claim 4 wherein said body is formed as a flat planar member with both said means for biasing the spindle brake operator to operate the spindle brake to halt rotation of the spindle and said means for retaining said actuator in an engaged, operating relationship with the spindle brake operator being mounted to a first planar side of said body and projecting outwardly therefrom, and wherein said handle is formed as at least one T-shaped member mounted to said body on a second planar side thereof for manual engagement of said T-shaped member for selective attachment of said actuator to and detachment of said actuator from the textile machine.

7. A portable actuator for a spindle brake according to claim 6 wherein said handle includes two T-shaped members disposed in a side-by-side relationship on said second planar side of said body for manual engagement for selective attachment of said actuator to and detachment of said actuator from the textile machine.

8. A portable actuator for a spindle brake according to claim 1 wherein said means for retaining said actuator in an engaged, operating relationship with the spindle brake operator includes at least one magnet mounted to said body and projecting outwardly therefrom for attachment to and detachment from a metal portion of the textile machine.

9. A portable actuator for a spindle brake according to claim 1 wherein said means for biasing the spindle brake operator includes a contoured resilient member projecting outwardly from said body for engagement with said spindle brake operator and said means for retaining said actuator in an engaged operating relationship with the spindle brake operator includes at least one magnet mounted to said body adjacent said contoured resilient member and projecting outwardly from said body for attachment to and detachment from a metal portion of the textile machine in and out of operating engagement with the spindle brake operator.

10. A portable actuator for a spindle brake according to claim 1 wherein said means for biasing the spindle brake operator includes a contoured resilient member projecting outwardly from said body for engagement with said spindle brake operator and said means for retaining said actuator in an engaged operating relationship with the spindle brake operator includes a pair of elongate magnets mounted to said body, with one member of said pair of magnets being mounted to said body at a first position adjacent said contoured resilient member and a second member of said pair of magnets being mounted to said body at a second position adjacent said contoured resilient member with said pair of magnets projecting outwardly from said body for attachment to and detachment from a metal portion of the textile machine.

11. A portable actuator for a spindle brake according to claim 10 wherein said pair of magnets is formed as a pair of cylinders.

12. A portable actuator for a spindle brake associated with a textile spinning machine, the spindle brake being operatively associated with a spindle, the spindle being associated with the textile spinning machine for take-up of textile strands by rotating a take-up bobbin mounted thereto, said actuator acting on a spindle brake operator associated with the textile spinning machine and operatively connected to the spindle to selectively halt rotation thereof, said actuator being selectively mountable to the textile machine to cause the spindle brake operator to engage and operate the spindle brake to halt spindle rotation, said spindle brake actuator comprising:

a body formed as a generally flat planar member having a first planar side and a second planar side;

means for biasing the spindle brake operator to operate the spindle brake to halt rotation of the spindle including a contoured resilient member projecting outwardly from said first planar side of said body for engagement with the spindle brake operator;

means for retaining said actuator in an engaged operating relationship with the spindle brake operator including a pair of elongate magnets mounted to said body, with one member of said pair of magnets being mounted to said body at a first position adjacent said contoured resilient member and a second member of said pair of magnets being mounted to said body at a second position adjacent said contoured resilient member, and with said pair of magnets projecting outwardly from said body for attachment to and detachment from a metal portion of the textile machine; and a handle including two T-shaped members disposed in a side-by-side relationship on said second planar side of said body for manual engagement for selective attachment of said actuator to and detachment of said actuator from the textile machine.

* * * * *